US010195537B2

(12) United States Patent
Yakos et al.

(10) Patent No.: US 10,195,537 B2
(45) Date of Patent: Feb. 5, 2019

(54) MULTI-CONFIGURABLE TOY RACE TRACK

(71) Applicant: Streamline Design LLC, Bozeman, MT (US)

(72) Inventors: David Yakos, Bozeman, MT (US); Joel Switzer, Belgrade, MT (US)

(73) Assignee: Streamline Design, LLC, Bozeman, MT (US)

( * ) Notice: Subject to any disclaimer, the term of this patent is extended or adjusted under 35 U.S.C. 154(b) by 0 days.

(21) Appl. No.: 15/012,009

(22) Filed: Feb. 1, 2016

(65) Prior Publication Data

US 2017/0216735 A1 Aug. 3, 2017

(51) Int. Cl.

| | |
|---|---|
| ***A63H 18/14*** | (2006.01) |
| ***A63H 17/26*** | (2006.01) |
| ***A63H 18/02*** | (2006.01) |
| ***A63H 18/04*** | (2006.01) |
| ***A63H 18/08*** | (2006.01) |
| ***A63H 29/22*** | (2006.01) |
| ***A63H 30/04*** | (2006.01) |
| ***A63H 17/14*** | (2006.01) |

(52) U.S. Cl.

CPC ..... *A63H 17/262* (2013.01); *A63H 17/14* (2013.01); *A63H 18/021* (2013.01); *A63H 18/028* (2013.01); *A63H 18/04* (2013.01); *A63H 18/08* (2013.01); *A63H 29/22* (2013.01); *A63H 30/04* (2013.01)

(58) Field of Classification Search

CPC .... A63H 17/14; A63H 17/262; A63H 17/264; A63H 18/04; A63H 18/021; A63H 18/028; A63H 18/00; A63H 18/08; A63H 18/16; A63H 29/22; A63H 30/04

USPC ..... 446/444, 445, 446, 447

See application file for complete search history.

(56) References Cited

U.S. PATENT DOCUMENTS

| | | | | | |
|---|---|---|---|---|---|
| 1,709,512 | A | * | 4/1929 | Alderdice | A63F 9/14 273/442 |
| 2,313,335 | A | * | 3/1943 | Godfrey | A63H 19/16 193/4 |
| 2,543,375 | A | * | 2/1951 | Phillips | A63H 5/00 446/228 |
| 2,789,391 | A | * | 4/1957 | Perry | A63H 21/04 104/120 |
| 3,477,172 | A | * | 11/1969 | Polewski | A63H 11/04 446/445 |

(Continued)

*Primary Examiner* — Melba Bumgarner
*Assistant Examiner* — Joseph B Baldori
(74) *Attorney, Agent, or Firm* — Fitzsimmons IP Law

(57) ABSTRACT

A system and method is provided for a toy race track. Preferred embodiments of the present invention operate in conjunction with a vehicle affixed to a track, wherein the track is supported in relation to at least one fixed surface via a plurality of support structures. In one embodiment, the track comprises a plurality of flexible sections, allowing a user to construct a track resembling a rollercoaster, having steep curves, upside-down portions, etc. In one embodiment, the vehicle includes a plurality rollers that can be used to both affix the vehicle to the track and propel the vehicle along the track. By affixing the vehicle to the track, the vehicle is prevented from leaving the track during extreme situations (e.g., steep curves, upside-down portions, etc.).

13 Claims, 9 Drawing Sheets

(56) References Cited

U.S. PATENT DOCUMENTS 3,540,153 A * 11/1970 Aoki ..... A63H 18/00 104/307
3,570,177 A * 3/1971 Tomaro ..... A63H 21/04 104/118
3,603,505 A * 9/1971 Tsugawa ..... A63H 21/04 238/10 A
3,604,148 A * 9/1971 Neuhierl ..... A63H 18/02 104/118
3,611,632 A * 10/1971 Smith ..... A63H 17/006 446/229
3,648,407 A * 3/1972 Pressman ..... A63H 18/08 104/120
3,698,130 A * 10/1972 Usami ..... A63H 18/08 446/445
3,699,711 A * 10/1972 Coffey, Sr. ..... A63H 18/14 446/445
3,782,293 A * 1/1974 Donohue ..... A63H 18/08 104/245
4,034,678 A * 7/1977 Wilson ..... A63H 21/04 104/118
4,217,727 A * 8/1980 Fetty ..... A63H 18/021 104/120
4,537,577 A * 8/1985 Sansome ..... A63H 18/08 104/120
4,861,306 A * 8/1989 Bolli ..... A63H 18/02 446/445
5,080,628 A * 1/1992 Tate ..... A63H 19/18 446/431
5,118,320 A * 6/1992 Miller ..... A63H 18/02 104/245
5,342,048 A * 8/1994 Jones ..... A63F 9/143 446/444
5,816,169 A * 10/1998 MacKenzie ..... A63H 21/04 104/118
5,868,599 A * 2/1999 Kaufman ..... A63H 33/38 446/148
6,220,171 B1 * 4/2001 Hettema ..... A63G 7/00 104/53
6,572,434 B2 * 6/2003 Man ..... A63H 18/16 104/53
6,746,298 B1 * 6/2004 Doepner ..... A63H 18/028 446/126
7,770,524 B1 * 8/2010 Wa ..... A63H 18/08 104/140
8,591,281 B2 * 11/2013 Mimlitch, III ..... A63H 29/22 446/3
9,114,324 B2 * 8/2015 Chuang ..... A63H 19/24
2007/0057080 A1 * 3/2007 Ngai ..... A63H 17/14 238/10 F

* cited by examiner

MULTI-CONFIGURABLE TOY RACE TRACK

BACKGROUND OF THE INVENTION

1. Field of the Invention

The present invention relates to a toy race track, or more particularly, to a toy race track system and method that allows a vehicle to be attached to a flexible track, allows the vehicle to remain attached to the track regardless of the track's configuration and/or orientation, and allows the track, which is preferably segmented and held in place via a plurality of user-configurable support structures, to be assembled (or arranged) into a plurality of different configurations and/or orientations.

2. Description of Related Art

Traditional model vehicles are designed for use either on their own (e.g., RF controlled model cars, RF controlled airplanes, etc.) or in conjunction with a traditional model track (e.g., a traditional model train/track system). With respect to the latter, however, model tracks are generally limited in the way in which they can be configured and oriented. For example, a model track for a model train is generally made up of straight track segments and curved track segments, thereby limiting the way in which the track can be configured (e.g., in a circle around a Christmas tree, etc.). Also, model track segments are generally ridged in construction, and are intended for use on a solid horizontal surface, such as a hardwood floor, or a piece of plywood. This construction limits the track's orientation to being parallel to the solid horizontal surface. In the case of a model train track, this emulates actual railroad tracks, which run parallel to the earth's surface. In the case of a model car track, this emulates actual raceways, which also run parallel (or substantially parallel) to the earth's surface.

Furthermore, because model tracks are generally oriented in this fashion (e.g., facing upward), and are generally configured in a circle, the track only needs to steer (or direct) the vehicle around corners, and prevent the vehicle from wandering side-to-side down straightaways. The track does not need to prevent the vehicle from moving away (perpendicularly) from the track. This is generally accomplished via gravity (e.g., gravity keeps a model train from moving upward, away from a train track). Because of this, a model vehicle generally does not need to be affixed to the model track, and only need to be placed on the model track. At most, such a vehicle is (i) prevented from moving side-to-side and/or (ii) maintained in electrical connection with the track. In a model train track, this is accomplished via a plurality of wheels positioned on two or more rails.

While traditional model vehicle/track systems are popular with consumers, the tracks are nonetheless limited in how they can be configured and/or oriented. It would thus be advantageous to have a flexible track that could be assembled in different ways, thereby allowing for configurations and orientations that are limited only by the user's imagination (practically speaking). Such a system and method, for example, would allow a user to create something akin to a model rollercoaster, as opposed to the traditional model train/track or car/raceway.

However, by allowing the track to be configured and oriented in such a fashion (e.g., to include loops, steep curves, upside-down straightaways, etc.), such a track could not be used with traditional model vehicles. This is because traditional vehicles are not attached to the track, and therefore have no mechanism in place to prevent the vehicle from falling away from the track, e.g., in a perpendicular direction. Thus, it would not only be advantageous to have a flexible track that can be assembled in different ways, but also a model vehicle that can be affixed to the track, thereby preventing the vehicle from leaving the track under extreme situations (e.g., steeped curves, upside-down straightaways, etc.). Moreover, the mechanism used to affix the vehicle to the track (or remove the vehicle from the track) should be easy to use, and quick to configure (e.g., between a removal mode and an affixed mode).

SUMMARY OF THE INVENTION

The present invention provides a system and a method for assembling a model track, the track preferably being flexible and user-configurable, and affixing a model vehicle to the track, thereby allowing the vehicle to remain attached to the track during extreme situation (e.g., steep curves, upside-down segments, etc.).

In a preferred embodiment of the present invention, the system includes at least one model vehicle operating on at least one model track, wherein the track is supported in relation to at least one fixed surface using a plurality of support structures. The track is preferably flexible, allowing a user to arrange (or assemble) the track into different configurations and/or orientations. By using a track that is flexible, user-configurable, and supported via any fixed surface, the track can be arranged to resemble something more akin to an actual rollercoaster, having steep curves, loops, upside down straightaways, etc.

In one embodiment of the present invention, a plurality of vehicles are attached to the track. For example, a first vehicle may be attached to the track, and a second vehicle may be attached to both the track and the first vehicle (e.g., via a coupler). By coupling the second vehicle to the first vehicle, only one vehicle needs to be motorized in order to propel both vehicles along the track.

In a preferred embodiment of the present invention, the vehicle (or each vehicle in the case of a multi-vehicle system) includes an attachment mechanism, allowing the vehicle to be affixed to (and removed from) the track. In one embodiment of the present invention, the vehicle includes both a chassis and a shell, wherein the chassis includes the attachment mechanism, and the shell provides an outer visual appearance of the vehicle to the user. The shell may visually depict, for example, a race car, a truck, a spaceship, or the like. In this embodiment, the shell is preferably removable from the chassis, thereby allowing different shells to be used with a single chassis. This can be accomplished, for example, using a plurality of tabs that are configured to snap either over the chassis or into corresponding slots in and/or on the chassis.

In one embodiment of the present invention, the vehicle includes a receiver for receiving at least one command from a user. For example, the receiver may be configured to receive a user command(s) from a hardwired controller and/or a wireless controller (i.e., a remote control). The received user command(s) is then provided to a controller (e.g., processor) and used to control at least a motor. In one embodiment of the present invention, the user command(s) may be a simple command, e.g., turn_motor_on, reverse_vehicle_direction, etc., and in other embodiments of the present invention, the user command(s) may be more complexed, e.g., setting a particular target speed (e.g., 60 mph, 5 on a scale of 1-10), etc. It should be appreciated that the vehicle can be powered by the track (e.g., like in traditional model trains) and/or using at least one battery (e.g., a battery within the vehicle that may be rechargeable and/or replaceable).

In addition to the electronics, the vehicle may further include a mechanical assembly that preferably includes at least one roller that is connected (at least indirectly) to the motor, wherein rotation of the motor results in rotation of the roller(s). Because the roller(s) is in physical contact with the track, rotation of the roller(s) results in the vehicle being propelled along the track. In one embodiment of the present invention, the motor is directly connected to the roller(s), so that rotation of the motor results in rotation of the roller(s). In another embodiment of the present invention, the motor is indirectly connected to the roller(s), so that rotation of the motor results in rotation of at least one intermediate device (e.g., a plurality of gears), which in turn results in rotation of the roller(s).

In a preferred embodiment of the present invention, the track includes at least one rail and the vehicle includes a plurality of rollers that can be positioned around the rail(s). This can be accomplished, for example, by attaching a first portion of a chassis to a first roller, attaching a second portion of the chassis to a second roller, and using a pivot (e.g., a hinge, which may be spring biased into a closed position) to attach the first portion of the chassis to the second portion of the chassis. The vehicle can then be placed in a "removal mode" by moving the second roller away from the first roller (e.g., using the pivot to move the second roller in relation to the first roller), and placed in an "affixed mode" by moving the second roller toward the first roller. In one embodiment, the first and second rollers are curved, thereby preventing the vehicle from leaving the track during extreme situations (e.g., steep curves, upside-down segments, etc.) when the vehicle is placed into the "affixed mode."

In one embodiment of the present invention, the track comprises a plurality of sections, where each section includes a single rail (i.e., monorail) that has a substantially circular outer surface and a flange that extends substantially perpendicular (e.g., downward) from the circular rail. In a preferred embodiment of the present invention, each end of the circular rail is hollow, or include a female receptacle. This allows a plurality of sections to be attached together, e.g., using at least one male pin. The flange, which is substantially flat, may include a plurality of holes, or openings, thereby allowing each section to be attached to at least one support section. Support sections are used to support the track in relation to (e.g., above, below, etc.) at least one fixed surface. By using a substantially circular, single rail, curved rollers can be used to both propel the vehicle along the track and prevent the vehicle from leaving the track during extreme situations.

Support structures may include a mid-track support structure, which can be attached to a middle portion of a track section and used to support the track section in relation to at least one fixed surface. Support structures may also include a track-to-track support structure, which can be used to connect two track sections together and/or to support two track sections in relation to at least one fixed surface. In other embodiments of the present invention, support structures may also include at least one longitudinal structure, at least one connector, and at least one structure that can be affixed to (or placed on) a fixed surface (e.g., a C-clamp, etc.). By way of example, a mid-track support structure may be used to connect a track section to a first longitudinal structure (e.g., arranged horizontally), the first longitudinal structure may be connected to a second longitudinal structure (e.g., arranged vertically), the second longitudinal structure may be connected to a C-clamp, and the C-clamp may be connected to a fixed surface (e.g., a table top, etc.). The end result is the track section being support in relation to the fixed surface (e.g., above the table top, etc.).

A more complete understanding of the system and method for assembling a user-configurable flexible track and/or affixing a vehicle to a user-configurable flexible track will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention relates to model race tracks, or more particularly, to a system and method that allows a vehicle to remain attached to a flexible track regardless of the track's configuration or orientation. The present invention further relates to a flexible track that can be user-assembled into a plurality of different configurations and orientations. In the detailed description that follows, like element numerals are used to describe like elements illustrated in one or more figures.

It should be appreciated that while the present invention is described herein in terms of a non-descript vehicle operating on a monorail track, the present invention is not so limited. For example, the invention could be used to emulate any vehicle (e.g., car, truck, train, spaceship, plane, rollercoaster, etc.) operating on any track (e.g., monorail, multi-rail (e.g., railroad track, etc.), rail-less (e.g., a track where the vehicle includes at least one wheel that is affixed inside at least one channel, etc.), etc.).

Figure 1:
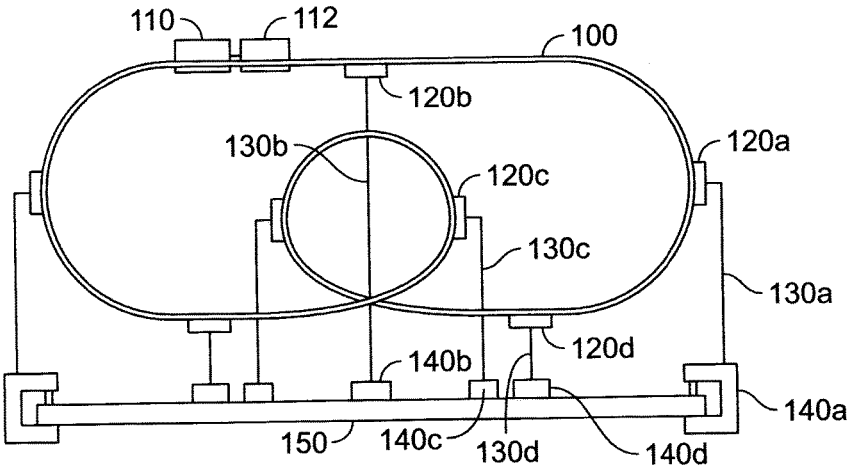
FIG. 1 illustrates a model vehicle/track system in accordance with one embodiment of the present invention.

In a preferred embodiment of the present invention, the system includes at least one model vehicle operating on at least one model track. For example, as shown in FIG. 1, the system includes a vehicle 110 operating on a track 100 that is supported via a plurality of support structures (e.g., 120*a-d*, 130*a-d*, 140*a-d*) attached to (or otherwise supported by) at least one fixed surface 150. In this embodiment, the track (or portions thereof) is flexible, allowing a user to arrange (or assemble) the track in different configurations and/or orientations. By using a track that is flexible, user-configurable, and supported via any fixed surface (e.g., located below the track, above the track, and/or to the side of the track), the track can be arranged (or assembled) to resemble something less akin to an actual railroad track, and more akin to an actual rollercoaster, having steep curves, loops, upside-down straightaways, etc.

Various details of the present invention will now be described. In doing so, reference will be made to various drawings, illustrating certain features of the present invention. It should be appreciated, however, that the present invention is not limited to the features illustrated in these drawings, including the types and/or number of components depicted therein. The drawings are merely to illustrate how the present invention may operate, or certain embodiments of the present invention, and is not intended to limit the present invention. Those skilled in the art will appreciate that various modifications can be made to the embodiments depicted and described herein without deviating from the spirit and scope of the present invention.

As described above, the system preferably includes at least one vehicle 110 (e.g., a first vehicle) operating on a track 100. The system may also include another vehicle 112 (e.g., a second or follower vehicle) operating on the same track 100, wherein the second vehicle 112 is connected (or coupled) to the first vehicle 110. An example of this can be seen in FIG. 2, where the second vehicle 112 is configured to follow the first vehicle 110. This can be done, for example, using a coupler (not shown) or any other coupling mechanism generally known those skilled in the art. By coupling the second vehicle 112 to the first vehicle 110, only one vehicle needs to be motorized. For example, if the first vehicle 110 includes a motor that can be activated to propel the first vehicle 110 around the track, then the second non-motorized vehicle 112 can be propelled around the same track by merely attaching the second vehicle 112 to the first vehicle 110.

Figure 2:
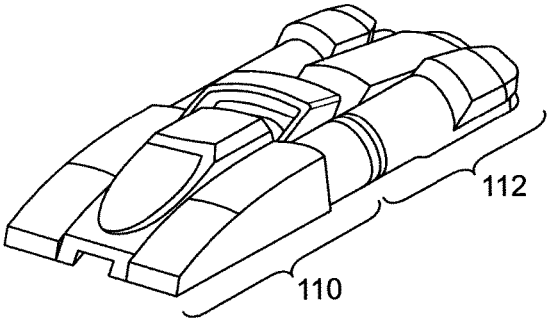
FIG. 2 illustrates a first model vehicle coupled to a second model vehicle, wherein the first model vehicle is preferably a motorized vehicle, and the second model vehicle is preferably a non-motorized vehicle (e.g., a follower vehicle)

It should be appreciated that the present invention is not limited to the type and/or number of vehicles depicted in FIG. 2. For example, the present invention may include only a single vehicle or multiple vehicles (e.g., two or more) connected to one another via mechanical and/or electrical couplers. For example, the second vehicle 112 may include a first coupler (not shown) on the front of the second vehicle 112, allowing the second vehicle 112 to be physically connected to the first vehicle 110, and a second coupler (not shown) on the back of the second vehicle 112, allowing the second vehicle 112 to be physically connected to a third vehicle (not shown). Similarly, the first and second vehicles 110, 112 may include electrical couplers (not shown), respectively, allowing the first and second vehicles 110, 112 to communicate with one another. This would allow, for example, the first vehicle 110 to instruct the second vehicle 112 to activate and/or deactivate (turn on and/or turn off) certain features (e.g., a motor, a light, a sound, etc.) in response to the first vehicle 110 receiving a corresponding command from a remote control (not shown) (e.g., turn lights on (generally), turn second vehicle's lights on, etc.).

The present invention is also not limited to only one vehicle being motorized when multiple vehicles are affixed to the track. For example, two different motorized vehicles could be uncoupled from one another and affixed to the same rail on the same track. In this embodiment, the vehicles could be independently controlled (e.g., via a remote control), allowing one vehicle to follow the other vehicle on the same track. In another example, two different motorized vehicles could be uncoupled from one another and affixed to different (e.g., side-by-side) rails on the same track. In this embodiment, the vehicles could race one another on the single track, with the different rails allowing each vehicle to be ahead of the other vehicle at different times. In another example, two different motorized vehicles could be coupled to one another and affixed to the same rail on the same track. In this embodiment, the first vehicle's motor could be operated to propel both vehicles along the track (the first vehicle pulling the second vehicle in a forward direction), the second vehicle's motor could be operated to propel both vehicles along the track (the second vehicle pushing the first vehicle in a forward direction), both vehicle's motors could be operated to propel both vehicle along the track, or the first vehicle's motor could be operated in a first direction (e.g., a forward direction) to propel both vehicles in a forward direction, and the second vehicle's motor could be operated in a second direction (e.g., a reverse direction) to propel both vehicles in a reverse direction.

Figure 3:
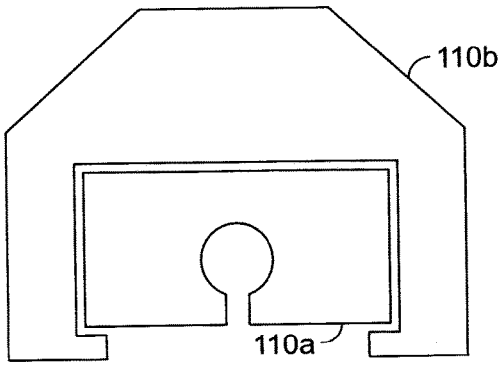
FIG. 3 illustrates the first model vehicle depicted in FIG. 2, comprising at least a chassis and a removable shell (e.g., a race-car shell, a rocket-ship shell, an airplane shell, etc.), wherein the chassis includes at least the motor of the vehicle.

Regardless of whether the vehicle is motorized or not, the vehicle (at least in a preferred embodiment) includes an attachment mechanism, allowing the vehicle to be affixed to (and removed from) the track. In one embodiment of the present invention, the motorized vehicle includes both a chassis and a shell, wherein the chassis includes both the motor and the attachment mechanism, and the shell provides an outer visual appearance of the vehicle to the user. The shell may visually depict, for example, a particular or generalized street car (e.g., Ford GT, Porsche 911, Dodge Challenger, etc.), race car (e.g., Grand Prix, Formula One, etc.), truck (e.g., dump truck, Ford F110, etc.), airplane (e.g., Grumman F-14 Tomcat, Boeing 747, etc.), train (freight train, passenger train, etc.), spaceship (Challenger, Enterprise, etc.), rollercoaster car (Ninja, Cyclone, etc.), or any other appearance known by those skilled in the art and/or desired by consumers, including the depiction of animated characters (e.g., Shrek, Lightening McQueen, Superman, etc.). As shown in FIG. 3, the shell 110*b* may be removable from the chassis 110*a*, thereby allowing different shells 110*b* to be used with a single chassis 110*a*. This can be accomplished, for example, using a plurality of tabs that allow the shell 110*b* to either snap over the chassis 110*a* (as shown in FIG. 3), or into corresponding slots on and/or in the chassis 110*a* (not shown). It should be appreciated that the removable shell feature is not limited to motorized vehicles, and is also applicable to non-motorized vehicles.

Figure 4:
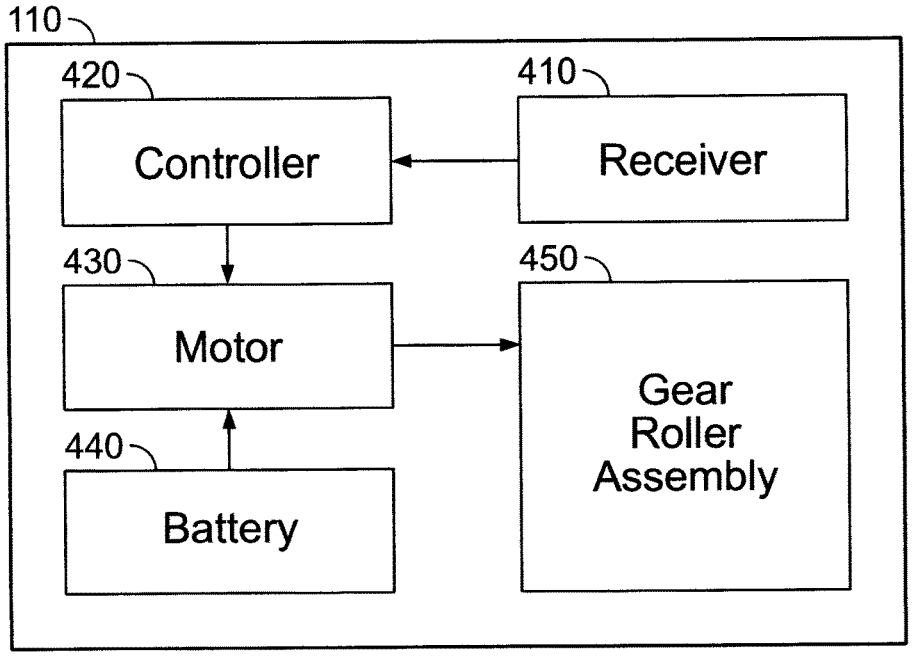
FIG. 4 provides a block diagram of the first model vehicle shown in FIG. 2, including a controller, a motor, a battery, a receiver, and a gear/roller assembly.

FIG. 4 provides a block diagram of a vehicle in accordance with one embodiment of the present invention. In this embodiment, the vehicle 110 includes a receiver 410 for receiving at least one command from a user. In one embodiment of the present invention, the user provides a command(s) by interacting with a controller (not shown) that is in direct electrical communication with the vehicle 110 (e.g., via a conductive path in the track, which is similar to how commands are communication in traditional model train/track systems). In another embodiment of the present invention, the user provides a command(s) by interacting with a remote control (not shown) that is configured to wirelessly communicates with the receiver 410 (e.g., via RF signals, infrared signals, Bluetooth, etc.). The user command is then provided to the controller 420 and used to control at least the motor 430. It should be appreciated that the command may be a simple command, such as motor_on, motor_off, motor_on_forward, motor_on_reverse, etc., or a complexed command, such as slow, fast, 10_mph, 5 on a scale of 1-10, etc. It should be appreciated that the controller 420 may be configured to receive multiple commands regarding operation of the motor (e.g., direction, speed, etc.), and/or commands regarding different features, such a turning on/off at least one light, playing at least one sound, and performing at least one mechanical operation. It should also be appreciated that the controller 420 may be configured to control the motor 430 (e.g., by generating a PWM signal(s) in response to the user command(s), etc.), or the motor 430 may be configured to control itself (e.g., by generating its own PWM signal(s) in response to (i) a user command(s) or (ii) a command(s) received from the controller 420 in response to the user command(s)). In one embodiment of the present invention, the vehicle 110 further includes at least one battery, which may be rechargeable, and/or replaceable. In this embodiment, the battery may be configured to power the motor, the controller, the receiver, and/or any other vehicle device requiring power (e.g., a light, a speaker, etc.).

In this embodiment of the present invention, the vehicle 110 further includes a mechanical assembly (e.g., gear/roller assembly 450) that includes at least one roller that is connected (at least indirectly) to the motor 430, wherein rotation of the motor 430 results in rotation of the roller(s). Because the roller(s) is adjacent to the track (e.g., in physical contact with the track), rotation of the roller(s) results in the vehicle being propelled along the track. In one embodiment of the present invention, the motor is directly connected to the roller, so that rotation of the motor results in rotation of the roller (e.g., by rotating a spindle that extends through both the motor and the roller, etc.). In another embodiment of the present invention, the motor is indirectly connected to the roller(s), so that rotation of the motor results in rotation of at least one intermediate device, which in turn results in rotation of the roller(s). This may be accomplished, for example using a plurality of gears. For example, rotation of the motor may result in rotation of a first gear, which results in rotation of a second gear, which results in rotation of the roller(s). It should be appreciated that the vehicle of the present invention is not limited to one that includes the components depicted in FIG. 4, and may include additional, fewer, and/or different components. For example, a vehicle that does not include a battery (e.g., is powered via the track), includes more than one battery, does not include a gear (e.g., provides a direct connection between the motor and the roller), does not include a roller (e.g., uses another rotating device (e.g., a gear, a chain, etc.) to propel the vehicle along the track), and/or includes at least one other component (e.g., a speaker, a light, etc.), is within the spirit and scope of the present invention.

In one embodiment of the present invention, the track includes a single rail (i.e., a monorail) and the vehicle is configured for attachment to the single rail. This can be seen, for example, in FIG. 5, where the vehicle is attached to the single rail (or track 100) via a plurality of rollers 500*a*, 500*b*. In this embodiment, the vehicle includes a chassis that includes a first portion 510*a* and a second portion 510*b*, wherein the first portion of the chassis 510*a* is connected to the second portion of the chassis 510*b* via a pivot 520 (e.g., a hinge, etc.), and the first portion of the chassis 510*a* includes a motor 540. The motor 540 is connected to a first roller 500*a* via a plurality of gears (550*a*, 550*b*). When the motor 540 is activated, the first gear 550*a* is rotated, which results in the rotation of the second gear 550*b* (e.g., via a meshing between the first and second gears). Rotation of the second gear 550*b* results in rotation of the first roller 500*a*, which in turn results in the vehicle being propelled over the track 100. In one embodiment, the first and second rollers 500*a*, 500*b* are curved and include a high friction surface (e.g., rubber, etc.). In another embodiment, the track also (or alternatively) includes a high friction surface (e.g., rubber, etc.).

The second portion of the chassis 510*b* may further include a handle 530, allowing a user to apply pressure to the second portion of the chassis 510*b*, thereby rotating (or moving) the second portion of the chassis 510*b* away from (or in relation to) the first portion of the chassis 510*a*. This rotation (or movement) of the second portion of the chassis 510*b* also results in the rotation (or movement) of the second roller 500*b* away from (or in relation to) the first roller 500*a*. This rotation (or movement) can best be seen in FIGS. 6 and 7, where FIG. 6 shows the vehicle in an "affixed mode," and FIG. 7 shows the vehicle in a "removal mode." In particular, FIG. 6 shows the vehicle 110 in an "affixed mode," where both rollers 500*a*, 500*b* are in physical contact with the track 100. In this mode, the vehicle 110 is affixed to the track 100, which prevents the vehicle 110 from falling off the track 100 during extreme situations (e.g., when the track goes upside down, etc.). By pushing on the lever 530, the vehicle can be moved into a "removal mode," which is shown in FIG. 7. In this mode, at least the second roller 500*b* is moved away from the track 100, thereby allowing the vehicle to be removed from (or taken off of) the track. In one embodiment of the present invention, the pivot (e.g., FIG. 5, 520) (e.g., hinge, etc.) is spring loaded, biasing the second roller toward the first roller (i.e., biasing the vehicle into the affixed mode).

Figure 5:
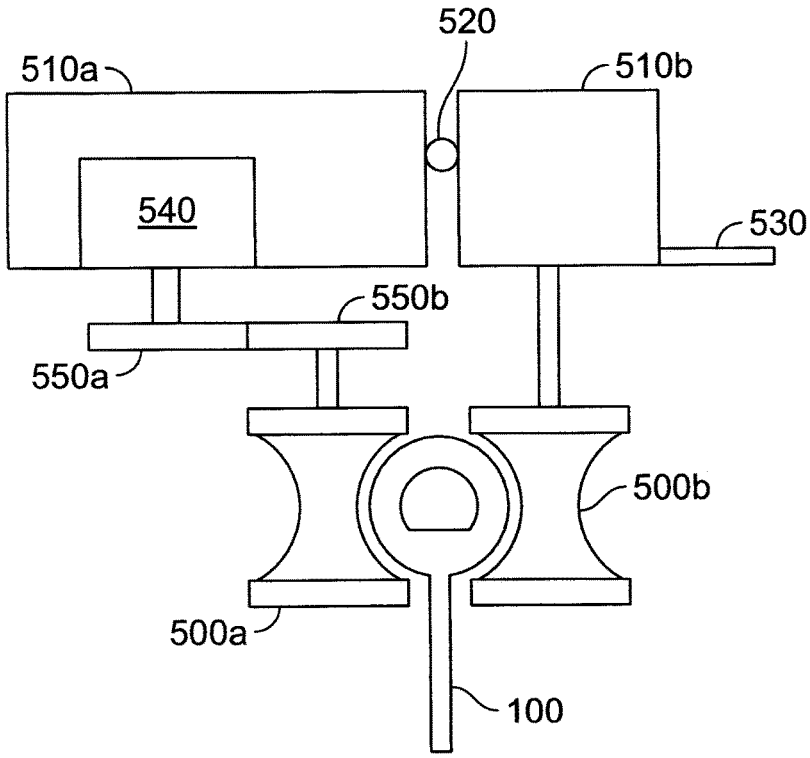
FIG. 5 illustrates various features of the model vehicle shown in FIG. 2, including the motor, a plurality of gears, and a plurality of rollers in physical communication with a track.
Figure 6:
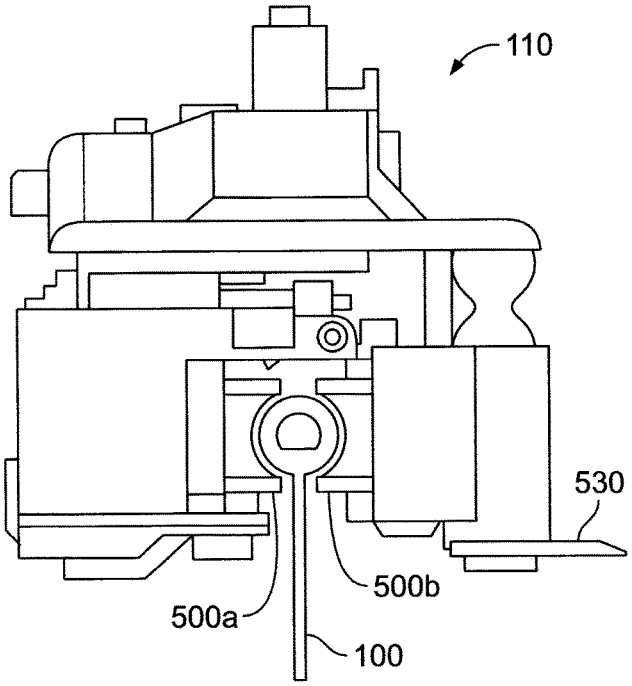
FIG. 6 depicts the model vehicle in an affixed mode, thereby affixing the model vehicle to the model track.
Figure 7:
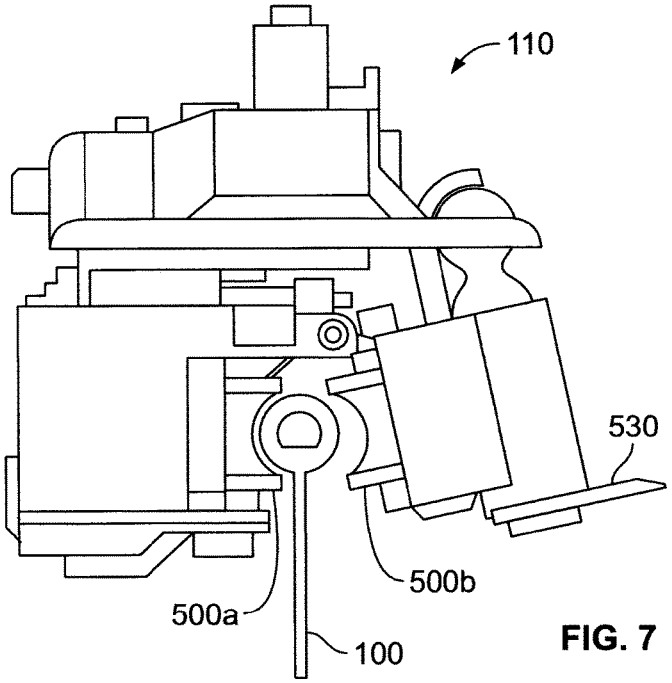
FIG. 7 depicts the model vehicle in a removal mode, thereby allowing the model vehicle to be removed from the model track.

It should be appreciated that the present invention is not limited to the vehicle(s) depicted in FIGS. 5-7. For example, a vehicle that includes additional, fewer, and/or different components is within the spirit and scope of the present invention. For example, the vehicle may include (i) more than one motor (e.g., a first motor in communication with a first roller and a second motor in communication with a second roller, a first motor for rotating a first roller in a first direction and a second motor for rotating the second roller in a second direction, etc.), (ii) a pivot that is located between the two rollers (e.g., allowing the first roller to move away from the second roller without requiring a multi-portion chassis), (iii) rollers that are not curved, (iv) additional rollers, and/or (v) a different mechanism for removing the vehicle from the track (e.g., allowing the second roller to be removed from the vehicle, etc.). In the example where the rollers are not curved, the rollers should preferably be shaped to correspond with the outer surface of the rail(s). A non-circular rail (e.g., an oval rail or a D-shaped rail where the upper portion is circular and the lower portion is flat) may be used, for example, to prevent the vehicle from rotating with respect to the rail.

It should also be appreciated that the spring for the pivot (or hinge) (when spring-biased) may be chosen to prevent the vehicle from leaving the track during certain situations (e.g., going into a curve at half-throttle, going into a loop at full throttle, etc.), but to allow the vehicle to leave the track during other situations (e.g., going into a curve at full-throttle, going into a loop at half (or less than half) throttle, etc.). This would require the user to vary the throttle in response to different situations. The failure to do so may result in the vehicle leaving the track (e.g., going into a curve at full throttle may result in the vehicle leaving the track, going upside down at low throttle may result in the vehicle leaving the track, etc.). It should further be appreciated that a different spring for the pivot (or hinge) may be chosen to prevent the vehicle from leaving the track during any situation, which may be more suitable for younger user. In an alternate embodiment, the spring-biased pivot, or the entire attachment assembly that includes the spring-biased pivot and/or roller(s), could be replaceable, thereby allowing the user to vary the degree of difficulty in operating the vehicle over the track.

It should further be appreciated that the vehicle may also include a speaker for playing at least one sound and/or a smoke unit (e.g., using water vapor atomizer technology, etc.) for generating smoke (or steam). In one embodiment, the controller (see, e.g., FIG. 4 at 420) may be configured to play at least one sound on the speaker and/or initiate the generation of smoke (or steam) from the smoke unit. This control may be done in response to a command from the user (e.g., allowing the user to select a sound (e.g., a horn, etc.), etc.) or done in response to an action performed by the vehicle (e.g., playing a "squealing tires" sound and/or generating smoke when the vehicle takes off, etc.). In one embodiment of the invention, the sound played may depend (at least partially) on the shell attached to the chassis. For example, at least one sound may be stored in a memory device within the shell. This would allow, for example, different horns to be played depending on whether the shell depicts a car or a truck, different engine noises to be made depending on whether the shell depicts an animated vehicle or a spaceship, etc. The data (e.g., sounds) may be communicated to the controller and/or speaker in the chassis via either hardwire or wirelessly (e.g., RFID, etc.). In an alternate embodiment of the preset invention, the data transmitted to the chassis is not the actual sound file(s), but at least one identification number, identifying the sound file(s) and/or the type of shell attached to the chassis (e.g., a particular car, a generic truck, etc.). This data could then be used to select an appropriate sound from a plurality of sounds stored on a memory device within the chassis.

Figure 8A:
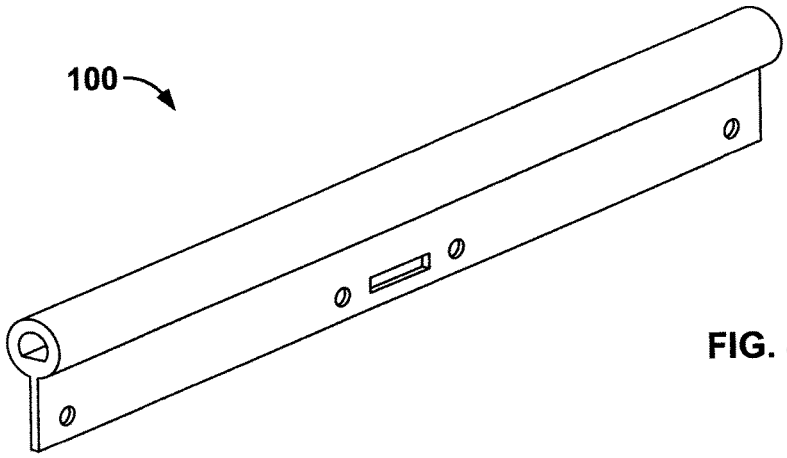
FIG. 8*a* provides a perspective view of a track segment in accordance with one embodiment of the present invention.
Figure 8B:
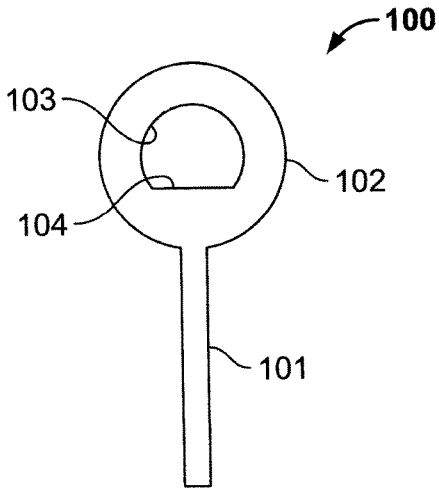
FIG. 8*b* provides an end view of the track segment shown in FIG. 8*a;*
Figure 8C:
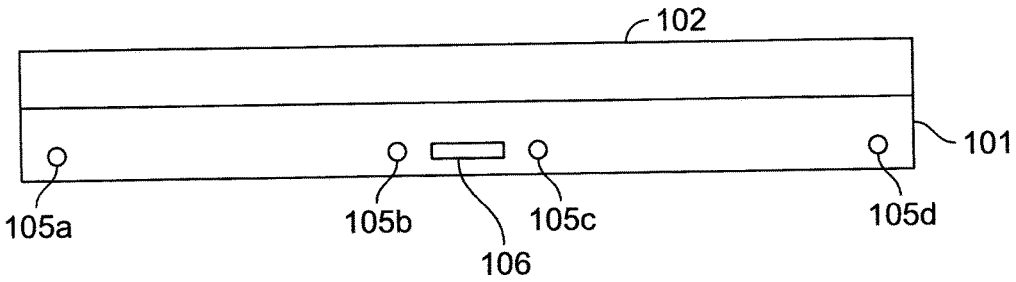
FIG. 8*c* provides a side view of the track segment shown in FIG. 8*a;*

In one embodiment of the present invention, the track includes a single rail (or monorail), and comprises a plurality of track sections. One track section can be seen in FIG. 8*a*, where the section 100 includes a single rail that has an outer surface that is substantially circular. This allows the curved rollers (see FIGS. 5-7) to both propel the vehicle along the track and prevent the vehicle from leaving the track during extreme situations (e.g., steep curves, upside-down portions, etc.). As shown in FIG. 8*b*, each end of the rail in the track section 100 is hollow, or includes a female receptacle. In one embodiment, the female receptacle is partially circular 103 and partially non-circular 104. As discussed in greater detail below, the non-circular portion prevents the track section 100 from rotating with respect to another track section (not shown). As shown in FIG. 8*c*, the track section may also include a flange portion 101, which extends perpendicularly downward from the circular rail, and includes a plurality of holes 105*a*-*d* and/or slots 106. As discussed in greater detail below, the holes/slots allow the track to be attached to at least one support structure and/or allows different track portions to be attached to one another. Again, it should be appreciated that the present invention is not limited to any particular type of track. As long as a track is user-configurable and provides at least one surface for a vehicle to be affixed thereto, then it is within the spirit and scope of the present invention.

Figure 9A:
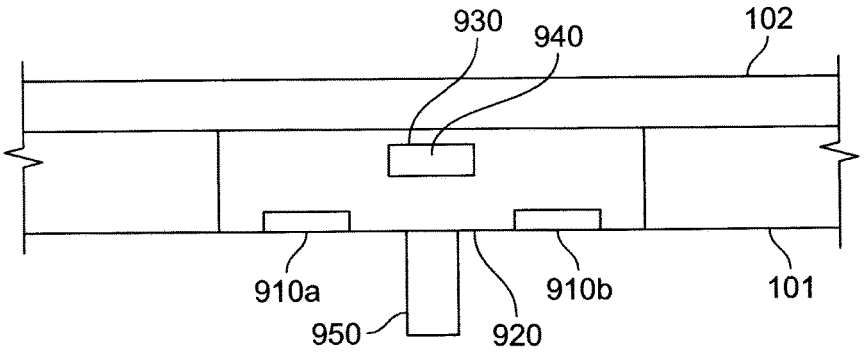
FIG. 9*a* illustrates a mid-track support structure for the track segment shown in FIG. 8*a;*
Figure 9B:
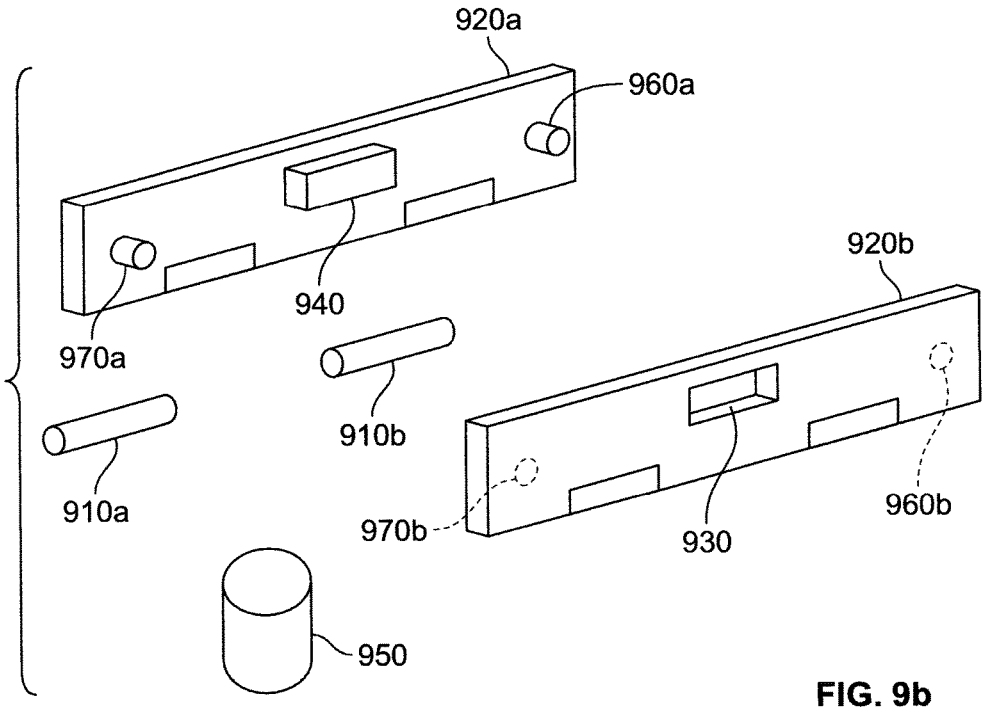
FIG. 9*b* illustrates an exploded view of the mid-track support section shown in FIG. 9*a;*

FIGS. 9*a* and 9*b* illustrate a mid-track support structure for supporting a track section in relation to a fixed surface (not shown). In one embodiment of the present invention, the mid-track support structure 920 includes a male pin 950 and two halves 920*a*, 920*b*, where the male pin 950 allows the mid-track support structure 920 to be connected to another support structure (not shown), and the two halves 920*a*, 920*b* allow the mid-track support structure 920 to be connected to a flange portion 101 of a track section. In particular, the first half 920*a* includes a plurality of projections 940, 960*a*, and 970*a*, the second half 920*b* includes a plurality of corresponding openings 930, 960*b*, and 970*b*, and the first and second halves 920*a*, 920*b* are connected together via a plurality of hinges 910*a*, 910*b*. The mid-track support structure 920 is connected to the track section by placing projections 940, 960*a*, and 970*a* on the first half 920*a* through corresponding openings in the flange portion 101 of the track section (see FIG. 8*c*) and into corresponding openings in the second half 920*b*. It should be appreciated that the present invention is not limited to the mid-track support structure depicted in FIGS. 9*a* and 9*b*, and any structure capable of supporting the track section in relation to a fixed surface is within the spirit and scope of the present invention.

Figure 10A:
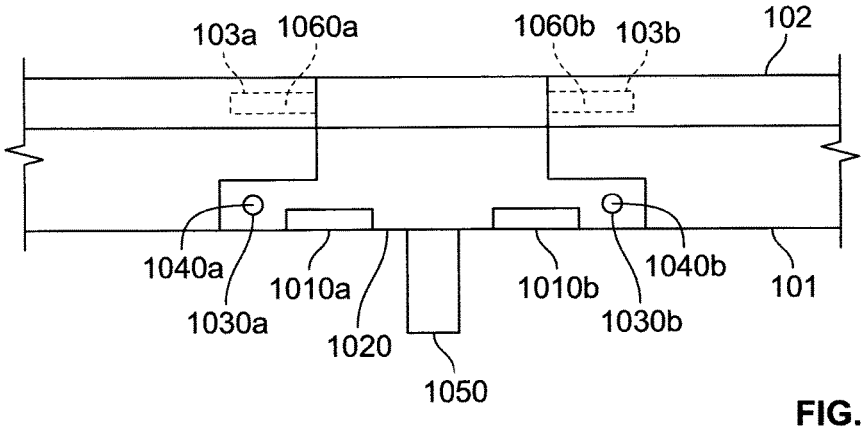
FIG. 10*a* illustrates a track-to-track support structure for the track segment shown in FIG. 8*a;*
Figure 10B:
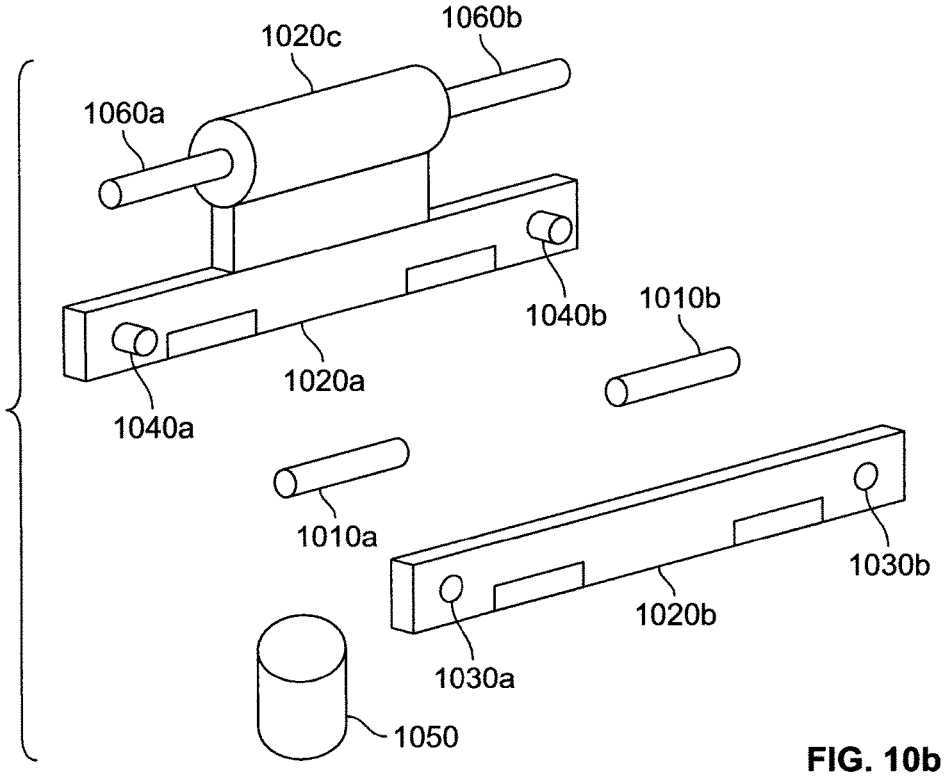
FIG. 10*b* illustrates an exploded view of the track-to-track support structure shown in FIG. 10*a;*

FIGS. 10*a* and 10*b* illustrate a track-to-track support section for supporting first and second sections in relation to a fixed surface (not shown), and for connecting the first track section to the second track section. In one embodiment of the present invention, the track-to-track support structure 1020 includes a male pin 1050 and two halves 1020*a*, 1020*b*, where the male pin 1050 allows the track-to-track support structure 1020 to be connected to another support structure (not shown), and the two halves 1020*a*, 1020*b* allow the track-to-track support 1020 to be connected to flange portions (i.e., 101, 101) of first and second track sections. In particular, the first half 1020*a* includes a plurality of projections 1040*a*, 1040*b*, the second half 1020*b* includes a plurality of corresponding openings 1030*a*, 1030*b*, and the first and second halves 1020*a*, 1020*b* are connected together via a plurality of hinges 1010*a*, 1010*b*. The first half 1020*a* also includes two male pins 1060*a*, 1060*b*, and a substantially circular rail 1020*c*. The track-to-track support structure 1020 is connected to the first and second track sections by placing a first end of the first track section (see FIG. 8*b*, showing an exemplary female receptacle) over the first male pin 1060*a* of the first half 1020*a*, placing a first end of the second track section (see FIG. 8*b*, showing an exemplary female receptacle) over the second male pin 1060*b*, and placing the projections 1040*a*, 1040*b* on the first half 1020*a* through corresponding openings in the flange portions 101 of the first and second track sections (see FIG. 8*c*, showing an exemplary flange portion of an exemplary track section) and into corresponding openings in the second half 1020*b*.

It should be appreciated that the present invention is not limited to the track-to-track support structure depicted in FIGS. 10*a* and 10*b*, and includes any structure capable of supporting the track section in relation to a fixed surface. For example, use of a male-to-male connector to attach a first track section to a second track section, and using a separate track-to-track support structure that attaches flange portions (i.e., 101, 101) of first and second track sections to at least one support structure is within the spirit and scope of the present invention.

Figure 11A:
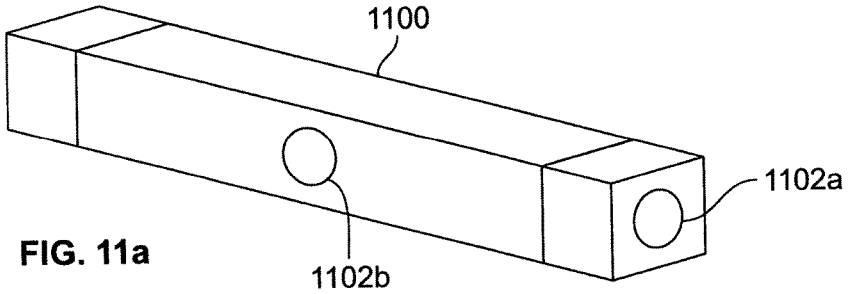
FIG. 11*a* illustrates a first support structure in accordance with one embodiment of the present invention.
Figure 11B:
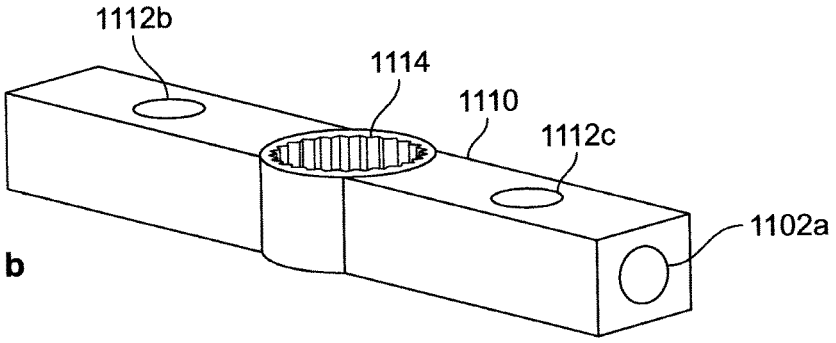
FIG. 11*b* illustrates a second support structure in accordance with one embodiment of the present invention.

In one embodiment of the present invention, a plurality of support structures can be used to support the track (or track sections) in relation to a fixed surface. For example, as shown in FIGS. 11*a* and 11*b*, a first support structure 1100 may include a first set of female openings 1102*a*, 1102*b*, and a second support structure 1110 may include a second set of female openings 1112*a*, 1112*b*, and 1112*c*. In another embodiment of the present invention, the first support structure 1100 may further include ends whose perimeters are reduced in size, and the second support structure 1110 may include at least one socket-like opening 1114. The opening 1114 is sized to receive either end of the first support structure (preferably only the ends of the first support structure that are reduced in size, and not the middle portion of the first support structure whose size is not reduced), and the socket-like design prevents the first support structure 1100 from rotating in relation to the second support structure 1110.

Figure 11C:
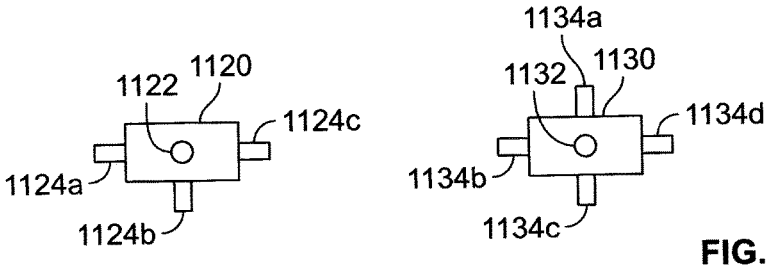
FIG. 11*c* illustrates different support structures (i.e., connectors) in accordance with one embodiment of the present invention, including a first connector that includes at least three male pins, and a fourth connector that includes at least four male pins.
Figure 11D:
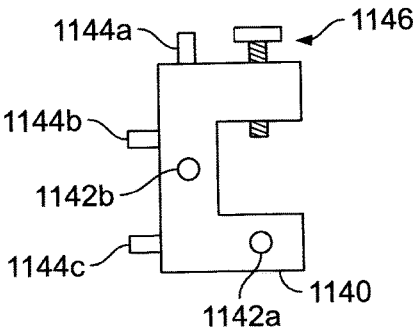
FIG. 11*d* illustrates a third support structure (e.g., a C-clamp) in accordance with one embodiment of the present invention, which can be used to affix a model track segment (e.g., alone or via other support structures) to a fixed surface (e.g., table top, etc.)

Other support structures are shown in FIGS. 11*c* and 11*d*, where a first connector 1120 includes at least one female opening 1122 and a first set of male pins 1124*a-c*, and a second connector 1130 includes at least one female opening 1132 and a second set of male pins 1134*a-d*. The third support structure 1140 includes a third set of female openings 1142*a-b*, a third set of male pins 1144*a-c*, and a C-clamp 1146 configured for attachment to a fixed surface (e.g., a table top, a door, a shelf, etc.). In one embodiment of the present invention, each male pin (e.g., the first, second, and third sets of male pins in FIGS. 11*c* and 11*d*) is configured to mate with a corresponding female opening (e.g., the first, second, and third sets of female openings in FIGS. 11*a*, 11*b*, and 11*d*, and the at least one female openings in FIG. 11*c*). It should be appreciated that the present invention is not limited to the support structures depicted in FIGS. 11*a-d*. Any structure(s) that supports, suspends, or otherwise fixes a track (or track segments) in relation to a surface (fixed or otherwise) is within the spirit and scope of the present invention. Thus, for example, the present invention may include any support structure that can be placed on or affixed to (e.g., via clamp, suction, glue, Velcro, etc.) any object (e.g., table, chair, window, door, railing, etc.).

Figure 12:
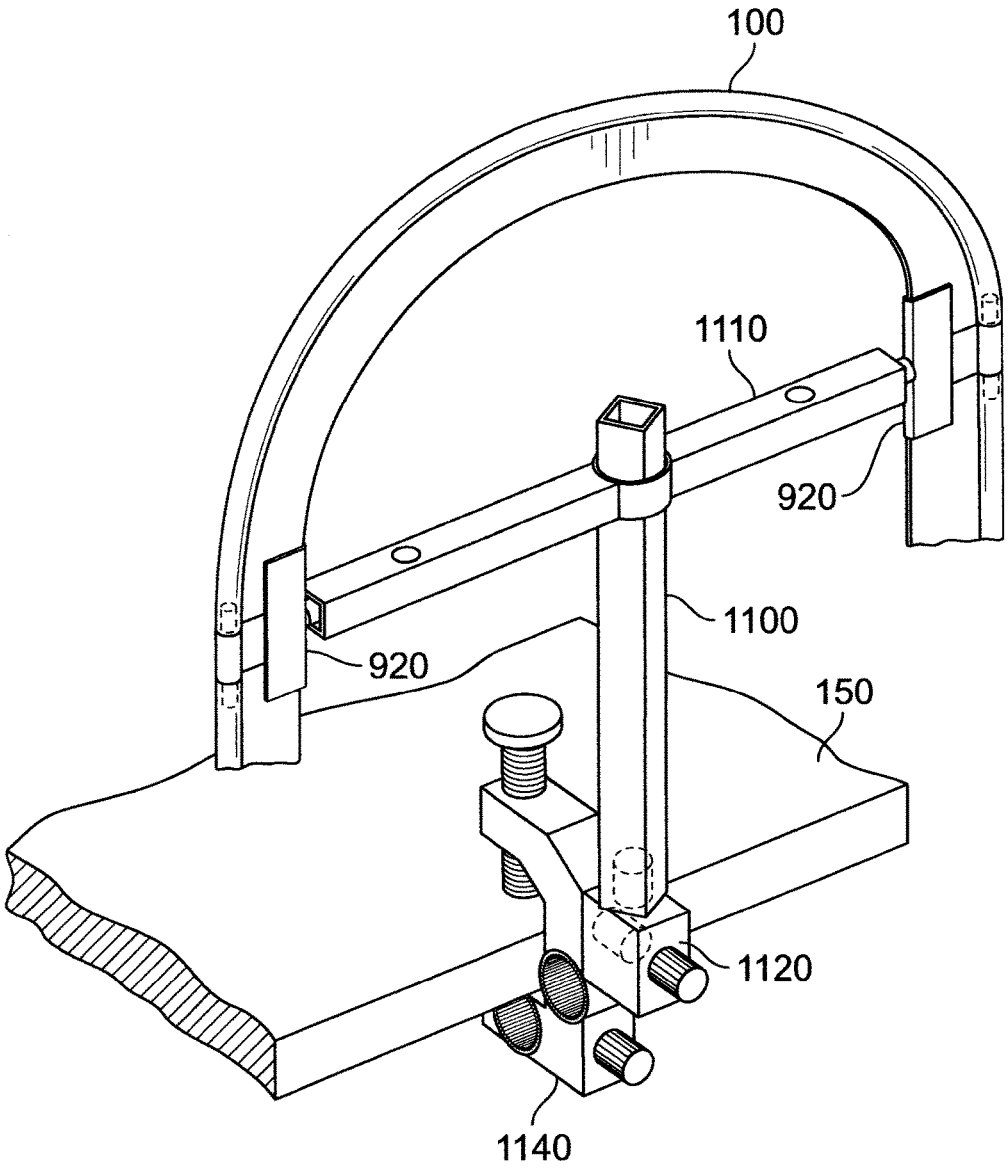
FIG. 12 illustrates an exemplary assembly of a plurality of support structures (as shown in FIGS. 11*a*-11*d*) and a plurality of model track segments (as shown in FIG. 8*a*)

FIG. 12 illustrates an exemplary way in which the support structures depicted in FIGS. 11*a-d* could be used to support a flexible track. In this figure, a plurality of track supports structures 920 (e.g., track-to-track supports, etc.) are used to connect the track 100 (or a plurality of track segments) to the second support structure 1110, which in turn is connected to the first support structure 1100. This may be accomplished by placing the male pins of the track supports sections 920 in corresponding female openings in the second support structure 1110, and placing the end of the first support structure 1100 in a corresponding opening in the second support structure 1110 (e.g., by placing the reduced perimeter end of the first support structure into the socket-like opening in the second support structure). The first support structure 1100 is then connected to the third support structure 1140 via the first connector 1120. This may be accomplished by placing a male pin of the third support structure 1140 into a female opening in the first connector 1120, and placing a male pin of the first connector 1120 into a female opening in the first support structure 1100. The third support structure 1140 is then connected to a fixed surface 150, such as a table. This may be accomplished, for example, by using a C-clamp to affix the third support structure 1140 to the fixed surface 150. It should be appreciated that FIG. 12 is merely exemplary, and thus should not be considered limiting in nature. FIG. 12 is only being used to illustrate how a plurality of support structures could be used to support a track (or track sections) in relation to a fixed surface.

Figure 13:
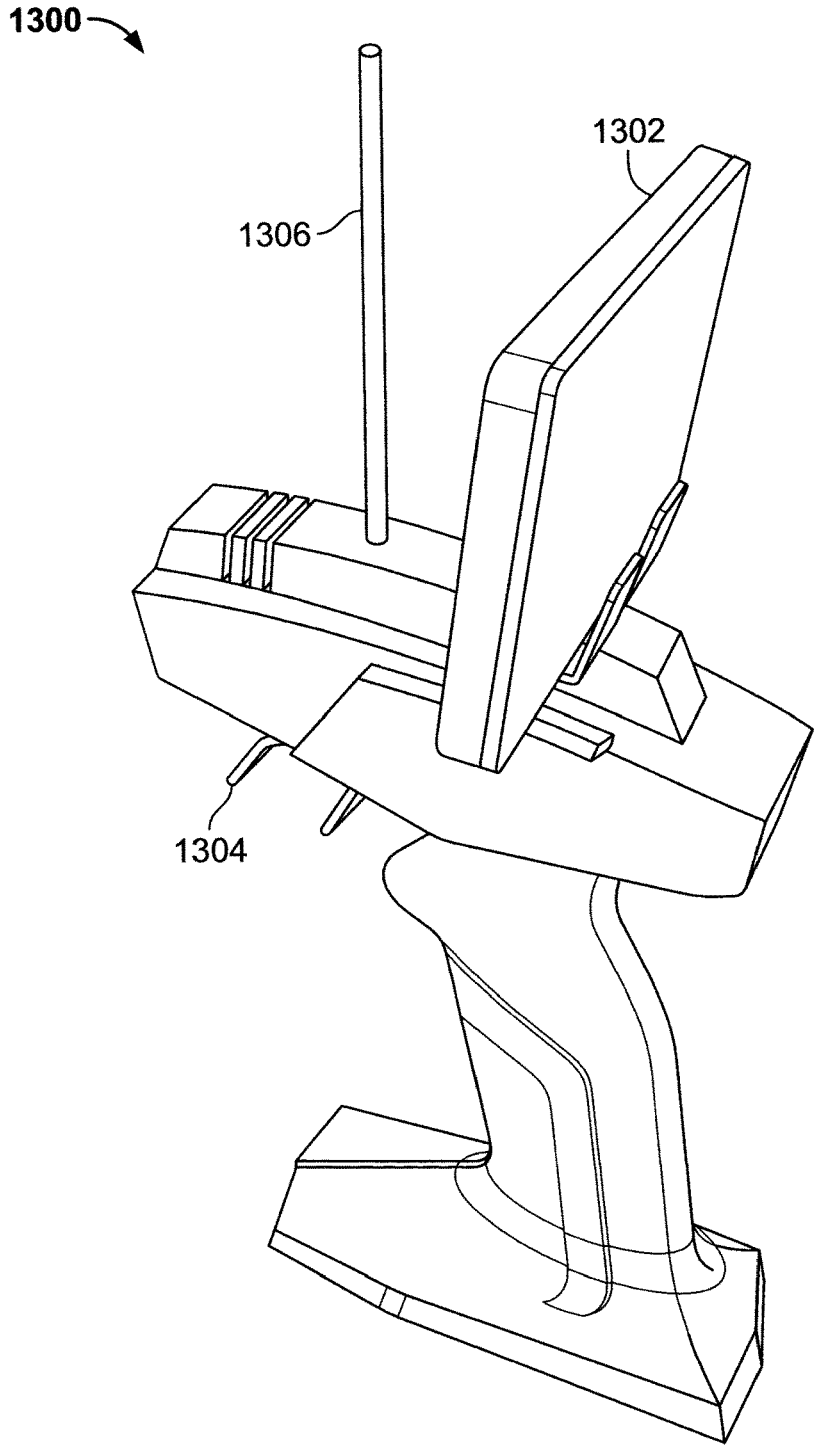
FIG. 13 illustrates a remote control in accordance with one embodiment of the present invention.

As discussed above in conjunction with FIG. 4, a receiver may be used to receive at least one control signal from a user via a remote control. To this end, an exemplary remote control is illustrated in FIG. 13. In one embodiment of the present invention, the remote control 1300 includes at least one user input 1304 (e.g., a spring-loaded trigger, a pressure-sensitive button, a biased toggle switch, etc.) for generating (or initiating the generation of) at least one control signal. The control signal is then transmitted via an antenna 1306 using a known communication protocol (e.g., RF, infrared, Wi-Fi, Bluetooth, etc.). The remote control may also include a holder (e.g., a slot) for supporting a smartphone, which can be used to record (e.g., via a camera) and share (e.g., via the Internet) user control of the vehicle on the track. It should be appreciated that the present invention is not limited to the remote control depicted in FIG. 13. For example, a remote control that includes additional user inputs (e.g., buttons, switches, etc.), and/or additional or fewer components (e.g., an internal antenna, a display screen for providing the user with information on the vehicle and/or track (e.g., target speed, direction, location on track, etc.), and/or a touch screen for providing user control of the vehicle (e.g., for setting target speed, direction, etc.) is within the spirit and scope of the present invention. It should be appreciated that use of a smartphone as the remote control (e.g., via a downloadable application) is also within the spirit and scope of the present invention.

Having thus described several embodiments of a system and method for a model vehicle/track, which may include a flexible model track that can be user-assembled into different configurations and/or orientations, a model vehicle that can be affixed to the flexible model track, and/or a model vehicle that can propelled along the flexible model track, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A toy race track system, comprising:

a flexible track comprising:

an upper portion having an outer surface that is cylindrical; and a lower portion that is configured for one of attachment to and placement on an object; and a vehicle configured to be propelled along said flexible track, said vehicle comprising:

a vehicle chassis comprising at least first and second portions;

a receiver configured to receive at least one user control;

a plurality of concaved rollers configured for placement substantially around said cylindrical outer surface of said upper portion of said flexible track, wherein a first one of said plurality of concaved rollers suspended at least indirectly from said first portion of said vehicle chassis is placed on a first side of said cylindrical outer surface and a second one of said plurality of concaved rollers suspended at least indirectly from said second portion of said vehicle chassis is placed on a second, opposite side of said cylindrical outer surface, thereby allowing said vehicle to remain attached to said flexible track even when said vehicle is upside down, where an upper surface of said vehicle is facing downward;

a motor configured for rotation, wherein said motor is located within said first portion of said vehicle chassis and said rotation of said motor results in a rotation of said first one of said plurality of concaved rollers, said second one of said plurality of concaved rollers being configured to rotate freely and independently from said motor;

a controller in communication with said receiver and said motor, and configured to at least one of initiate and control said rotation of said motor in response to receiving said at least one user control; and at least one hinge connecting said first and second portions of said vehicle chassis, wherein rotation of said at least one hinge in a first direction results in said second portion of said vehicle chassis and therefore said second one of said plurality of concaved rollers and its entire axle being rotated upward and away from said first portion of said vehicle chassis and therefore said first one of said plurality of concaved rollers, and rotation of said at least one hinge in a second direction results in said second portion of said vehicle chassis and therefore said second one of said plurality of concaved rollers and its entire axle being rotated downward and toward said first portion of said vehicle chassis and therefore said first one of said plurality of concaved rollers;

wherein said at least one hinge is rotated in said first direction to release said vehicle from said flexible track, and rotated in said second direction to attach said vehicle to said flexible track, when rotating in said first direction said first one of said plurality of concaved rollers remains fixed in relation to said motor while said second one of said plurality of concaved rollers and its entire axle rotates about said at least one hinge, and upward and away from said first one of said plurality of concaved rollers.

2. The toy race track system of claim 1, wherein said hinge is spring-loaded, biasing said hinge in said second direction.

3. The toy race track system of claim 1, wherein said first one of said plurality of curved rollers is suspended from said first portion of said vehicle chassis via at least said motor.

4. The toy race track system of claim 1, wherein said vehicle further comprises a plurality of gears, and said rotation of said motor results in a rotation of a first one of said plurality of gears, and said rotation of said first one of said plurality of gears results in a rotation of a second one of said plurality of gears, and said rotation of said second one of said plurality of gears results in said rotation of said first one of said plurality of concaved rollers.

5. The toy race track system of claim 1, wherein said vehicle further comprises at least one battery that is configured to power at least said motor.

6. The toy race track system of claim 1, wherein said receiver is configured to receive said at least one user control from a remote control.

7. The toy race track system of claim 1, wherein said vehicle further comprises a shell configured for attachment to said vehicle chassis, wherein said vehicle chassis houses at least said receiver, said plurality of concaved rollers, said motor, said controller, and said hinge.

8. The toy race track system of claim 1, wherein said vehicle further comprises a speaker, and said controller is further configured to play at least one sound on said speaker.

9. The toy race track system of claim 8, wherein said at least one sound is played in response to one of said at least one user control and an action of said vehicle.

10. The toy race track system of claim 1, wherein said flexible track comprises a plurality of flexible track portions, where each one of said flexible track portions includes a distal end and a proximal end, wherein at least said distal end includes an inner opening comprising a female socket that is adapted to receive a male pin, said male pin being connected to flat portions that are configured to mate with said lower portion of said flexible track, said flat portions preventing said male pin from rotating with respect to said female socket.

11. A toy race track system, comprising:

a flexible track comprising:

a rail portion having a cylindrical outer surface; and a flange portion that is configured for attachment to at least one support structure, said at least one support structure being one of attached to and placed on an object; and a vehicle configured to be propelled along said flexible track, said vehicle comprising:

a receiver configured to receive at least one user control;

a plurality of concaved rollers configured for placement substantially around said cylindrical outer surface of said rail portion of said flexible track, wherein a first one of said plurality of concaved rollers is placed on a first side of said cylindrical outer surface of said rail portion and a second one of said plurality of concaved rollers is placed on a second, opposite side of said cylindrical outer surface of said rail portion, thereby allowing said vehicle to remain attached to said flexible track regardless of said vehicle's orientation, including when said vehicle is substantially upside down;

a motor configured for rotation, wherein said rotation of said motor results in a rotation of at least said first one of said plurality of rollers, said second one of said plurality of rollers rotating independently from said motor;

a controller in communication with said receiver and said motor, and configured to at least one of initiate and control said rotation of said motor in response to receiving said at least one user control; and a hinge connected between a first structural portion and a second structural portion, said hinge being rotatable in a first direction to move said second structural portion, said second one of said plurality of concaved rollers and its entire axle upward and away from said first structural portion and said first one of said plurality of concaved rollers when said vehicle is being removed from said flexible track, and rotated in a second direction to move said second structural portion, said second one of said plurality of concaved rollers and its entire axle downward and toward said first structural portion and said first one of said plurality of concaved rollers when said vehicle is being attached to said flexible track; and wherein said motor is within or connected to said first structural portion and said first one of said plurality of rollers remaining fixed with respect to said motor.

12. The toy race track system of claim 11, wherein said vehicle further comprising a housing that includes at least said first and second structural portions, wherein said first structural portion of said housing is further connected to said second structural portion of said housing via spring.

13. The toy race track system of claim 12, wherein said vehicle further comprises a shell configured for attachment to said housing, thereby providing a toy race track system that allows for the use of interchangeable shells.

* * * * *